US011313012B2

(12) United States Patent
Gupta et al.

(10) Patent No.: US 11,313,012 B2
(45) Date of Patent: Apr. 26, 2022

(54) ULTRA-HIGH STRENGTH AND CORROSION RESISTANT ALUMINUM ALLOYS VIA A COMBINATION OF ALLOYING ELEMENTS AND ASSOCIATED PROCESS

(71) Applicants: Rajeev Gupta, Hudson, OH (US); Javier Esquivel, Cuyahoga Falls, OH (US)

(72) Inventors: Rajeev Gupta, Hudson, OH (US); Javier Esquivel, Cuyahoga Falls, OH (US)

(73) Assignee: The University of Akron, Akron, OH (US)

( * ) Notice: Subject to any disclaimer, the term of this patent is extended or adjusted under 35 U.S.C. 154(b) by 380 days.

(21) Appl. No.: 16/281,337

(22) Filed: Feb. 21, 2019

(65) Prior Publication Data

US 2019/0256953 A1 Aug. 22, 2019

Related U.S. Application Data

(60) Provisional application No. 62/633,165, filed on Feb. 21, 2018.

(51) Int. Cl.

| | |
|---|---|
| ***C22C 1/04*** | (2006.01) |
| ***C22C 21/00*** | (2006.01) |
| ***B22F 3/02*** | (2006.01) |

(52) U.S. Cl.

CPC ..... *C22C 1/0416* (2013.01); *C22C 21/00* (2013.01); *B22F 3/02* (2013.01); *B22F 2301/052* (2013.01); *B22F 2303/01* (2013.01); *B22F 2999/00* (2013.01)

(58) Field of Classification Search

CPC . C22C 1/0416; C22C 21/00; B22F 2301/052; B22F 3/02; B22F 2003/023; B22F 3/04

See application file for complete search history.

(56) References Cited

U.S. PATENT DOCUMENTS 5,037,608 A * 8/1991 Tarcy ..... C22C 1/026 420/528
5,976,456 A * 11/1999 Ziani ..... B22F 1/0085 148/513
6,902,699 B2 * 6/2005 Fritzemeier ..... B22F 9/04 419/38

OTHER PUBLICATIONS

Esquivel et al. ("Corrosion Behavior and Hardness of Al-M (M: Mo, Si, Ti, Cr) Alloys." Acta Metallurgica Sinica (English Letters) 30.4 (2017): 333-341.) (Year: 2017).*

J. Esquivel et al.; (2018); Excellent corrosion resistance and hardness in Al alloys by extended solid solubility and nanocrystalline structure, Materials Research Letters, 6:1, 79-83; Published online: Nov. 3, 2017.

(Continued)

*Primary Examiner* — Anthony J Zimmer
*Assistant Examiner* — Ricardo D Morales
(74) *Attorney, Agent, or Firm* — Renner Kenner Greive Bobak Taylor & Weber

(57) ABSTRACT

A method of making an alloy includes mechanically alloying aluminum with an alloying element to form an alloy. The method may include a subsequent step of compacting the alloy powder to form an aluminum alloy compact. The alloying element may be chromium (Cr), nickel (Ni), molybdenum (Mo), titanium (Ti), manganese (Mn), vanadium (V), niobium (Nb), or silicon (Si).

8 Claims, 4 Drawing Sheets

(56) References Cited

OTHER PUBLICATIONS

Materials Science & Technology 2016 Technical Meeting and Exhibition; Oct. 23-27, 2016; see p. 69.
J. Esquivel et al.; Thermal stability of nanocrystalline Al-5at.%Ni and Al-5at.%V alloys produced by high-energy ball milling; Journal of Alloys and Compounds 744 (2018) 651-657.
J. Esquivel et al.; Influence of the V content on microstructure and hardness of high-energy ball milled nanocrystalline Al—V alloys; Journal of Alloys and Compounds 760 (2018) 63-70.
R.K. Gupta et al.; Simultaneous improvement in the strength and corrosion resistance of Al via high-energy ball milling and Cr alloying; Materials and Design 84 (2015) 270-276.
R.K. Gupta et al.; Corrosion behaviour and hardness of in situ consolidated nanostructured Al and Al—Cr alloys produced via high-energy ball milling; Corrosion Science 98 (2015) 643-650.

* cited by examiner

ULTRA-HIGH STRENGTH AND CORROSION RESISTANT ALUMINUM ALLOYS VIA A COMBINATION OF ALLOYING ELEMENTS AND ASSOCIATED PROCESS

CROSS-REFERENCE TO RELATED APPLICATIONS

The present application claims the benefit of U.S. Provisional Patent Application No. 62/633,165, filed Feb. 21, 2018, incorporated herein by reference.

FIELD OF THE INVENTION

Embodiments of the invention are directed to alloys having improved properties, such as increased hardness and corrosion resistance. The alloys may be made by a method including a step of alloying, which may be high-energy ball milling. The method may include a step of subsequent compaction, which may be cold compaction.

BACKGROUND OF THE INVENTION

The development of aluminum alloys with high strength and corrosion resistance has been a topic of recent interest, particularly for the automotive, marine, and aerospace industries. In these industries, existing alloys have provided certain improvements in mechanical and corrosion properties, allowing improvements in fuel efficiency and longevity while also decreasing carbon emissions. However, certain existing aluminum alloys are limited to a maximum strength of 600 MPa. Moreover, conventional techniques to increase the strength of certain aluminum alloys tend to result in a corresponding decrease in corrosion properties. For example, in the alloy AA 7075-T651, the second phase particles that are responsible for increasing the strength of the alloy also promote micro-galvanic interactions that initiate localized corrosion.

Seeking further improvements in aluminum alloys, certain efforts have focused on developing new alloys to achieve improved properties of the alloys. However, since the solubility of most alloying elements in aluminum is extremely limited, substantial formation of secondary phases is inevitable through conventional processing methods. These secondary phases cause localized corrosion, thereby affecting the overall corrosion resistance of these alloys.

For the processing method of sputtering, certain binary aluminum alloys produced by sputtering have indeed demonstrated relatively high resistance to localized corrosion. This was attributed to the extended solid solubility of the alloying elements. But, these alloys made by sputtering generally lack the possibility of improving mechanical properties of the substrate to which it is applied. Also, the potential applications for these alloys were limited based on certain limitations inherent to the sputtering technique.

High-energy ball milling has been utilized in the art, including by one of the present co-inventors, with certain aluminum alloys. Yet, given the need for alloys having both increased strength and better corrosion resistance, there remains a need in the art for improved alloys and corresponding methods of making the alloys.

SUMMARY OF THE INVENTION

In a first embodiment, an alloy powder includes from 50 to 99 atomic percent aluminum and from 1 to 50 atomic percent of an alloying element, wherein the alloying element is selected from the group consisting of nickel (Ni), molybdenum (Mo), titanium (Ti), manganese (Mn), vanadium (V), niobium (Nb), and silicon (Si).

In another embodiment, a method of making an aluminum alloy compact includes mechanically alloying aluminum powder with an alloying element metal powder to thereby form an alloy powder, and compacting the alloy powder to thereby form an aluminum alloy compact.

In still another embodiment, a method of making an aluminum alloy compact includes combining aluminum powder, an alloying element metal powder, and grinding balls in a ball mill rotation pot, rotating the ball mill rotation pot in a disk-planetary ball mill to thereby form an alloy powder from the aluminum powder and the alloying element metal powder, filling a receptacle of a die with the alloy powder, and compacting the alloy powder within the die to thereby form an aluminum alloy compact.

BRIEF DESCRIPTION OF THE DRAWINGS

Advantages of the present invention will become better understood with regard to the following description, appended claims, and accompanying drawings wherein:

DETAILED DESCRIPTION OF THE INVENTION

Embodiments of the invention are directed to alloys and corresponding methods of making the alloys. The alloys contain aluminum and an additional metal, which may be referred to as an alloying element and which may be a transition metal. The alloys may be made by a method including steps of mechanically alloying particles of aluminum with the alloying element to form an alloy. This alloy, which may be in the form of powder, may be compacted to form an alloy compact. The alloy compact may be in the form of a pellet. The mechanical alloying step may include high-energy ball milling. The compacting step may be a cold compaction. It has been advantageously found that methods according to embodiments of the invention result in alloys having beneficial properties, such as increased hardness and improved corrosion resistance. This ability to improve both hardness and corrosion resistance is significant because conventional techniques to increase the strength of certain alloys generally result in a corresponding decrease in corrosion resistance. Alloys according to embodiments of the invention have increased hardness while also having improved corrosion resistance.

Figure 1:
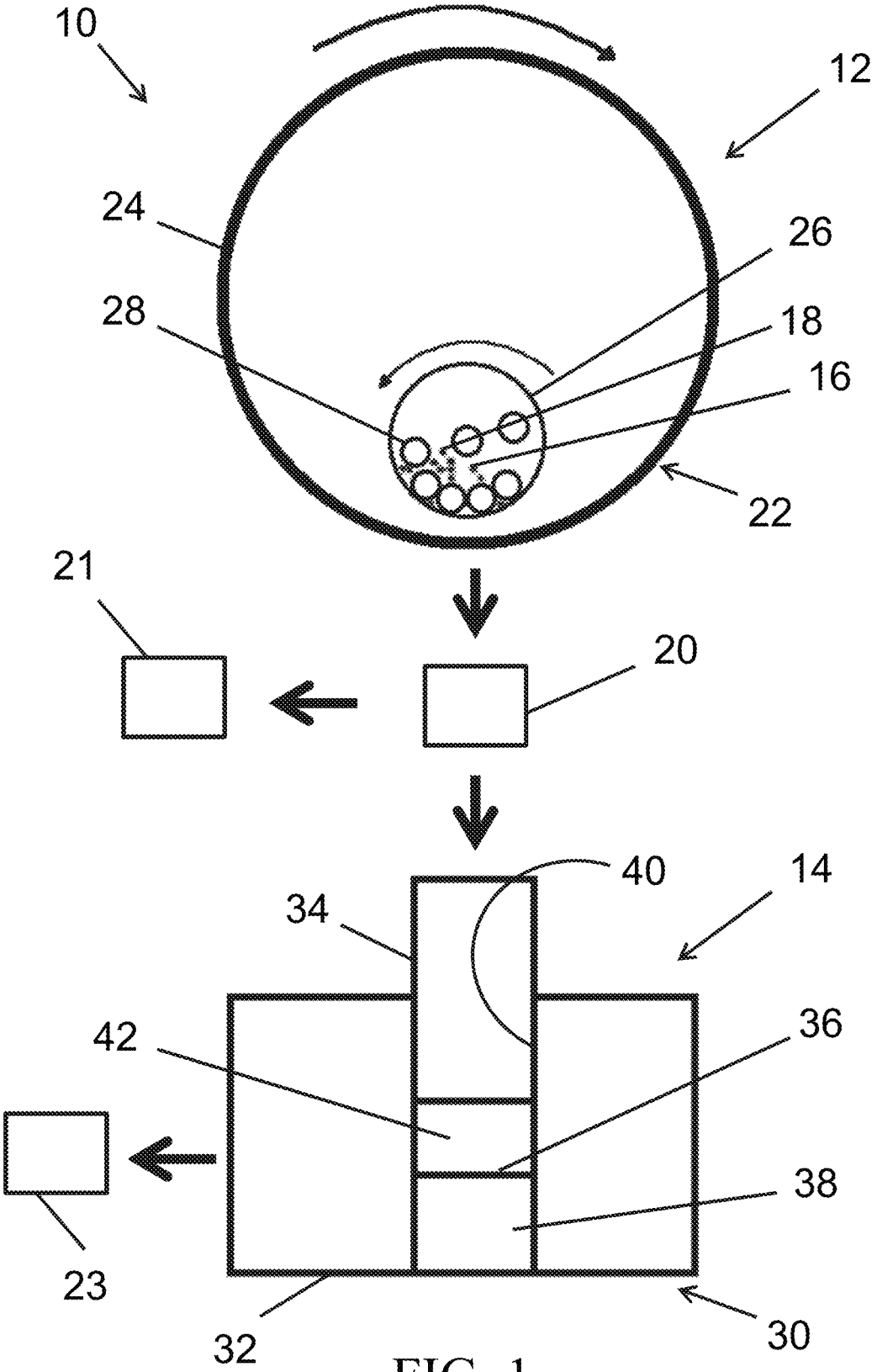
FIG. 1 is a schematic of a method according to one or more embodiments of the present invention.

With reference to FIG. 1, a method 10 of making alloys includes an alloying step 12 followed by a compacting step 14. Alloying step 12 combines aluminum particles 16, which may be in the form of powder, with alloying element particles 18, which may be in the form of powder, to form an alloy. The alloy is collected, as shown in step 20. In one or more embodiments, the alloy from step 20, which may also be referred to as alloy powder 20, may be utilized as an alloy powder product 21 in a variety of applications without being provided to compacting step 14, as further described herein. In one or more embodiments, the alloy from step 20 is provided to compacting step 14. In compacting step 14, the alloy (e.g. alloy powder) is compacted to form one or more alloy compacts 23. Alloy compact 23 is collected and may be utilized in a variety of applications, as further described herein. In one or more embodiments, a portion of the alloy from step 20 is provided as alloy powder product 21 and a portion of the alloy from step 20 is provided to compacting step 14 to form alloy compacts 23.

Aluminum metal particles 16, which may also be referred to as aluminum powder 16, contain aluminum metal to produce alloys. Aluminum is a relatively soft metal and therefore requires strengthening in order to be useful for certain applications.

Aluminum powder 16, which may also be referred to as an elemental powder, may be characterized by the content of pure aluminum within the powder with respect to other constituents that are not aluminum, also referred to as the purity of the powder. In one or more embodiments, aluminum powder 16 has a purity of at least 99 wt. %, in other embodiments, at least 99.5 wt. %, and in other embodiments, at least 99.7 wt. % aluminum.

Aluminum powder 16 may be characterized by the size of the metal particles within the powder. In one or more embodiments, aluminum powder 16 has a size of from −50 mesh to +100 mesh, in other embodiments, from −100 mesh to +500 mesh, and in other embodiments, from −25 mesh to +50 mesh.

Alloying element metal particles 18, which may be referred to as alloying element powder 18 or transition metal particles 18, may be made of any suitable metal that imparts improved hardness and corrosion resistance properties to the alloy compact 23. In one or more embodiments, alloying elements 18 are made of a transition metal selected from the group consisting of chromium (Cr), nickel (Ni), molybdenum (Mo), titanium (Ti), manganese (Mn), vanadium (V), and niobium (Nb). In one or more embodiments, alloying elements 18 are made of silicon (Si). In particular embodiments, alloying elements 18 are made of a transition metal selected from the group consisting of Mo, V, and Nb.

Alloying elements 18 may be characterized by the amount of chemically pure content of the particular alloying element within the powder with respect to other constituents that are not that of the alloying element, also referred to as the purity of the powder. In one or more embodiments, a powder made of alloying element 18 has a purity of at least 99 wt. %, in other embodiments, at least 99.5 wt. %, and in other embodiments, at least 99.8 wt. % alloying element.

A powder made of alloying elements 18 may be characterized by the size of the alloying element metal particles 18 within the powder. In one or more embodiments, alloying element metal particles 18 have a size of −100 mesh or approximate thereto, in other embodiments, from −50 mesh to +100 mesh, and in other embodiments, from −25 mesh to +50 mesh.

Aluminum powder 16 and alloying element 18 merge together within alloying step 12. Alloying step 12, which may also be referred to as mechanical alloying step 12, may be any suitable step for alloying aluminum particles 16 with alloying elements 18 to form an alloy, which may be referred to as an alloy powder as in step 20. Exemplary alloying steps 12 include high-energy ball milling (HEBM), cryomilling, gas-dynamic cold-spray and additive manufacturing. Alloying step 12 may be dry or wet.

Where alloying step 12 includes high-energy ball milling, this step generally serves to merge together aluminum powder 16 and alloying elements 18 into an alloy powder 20. High-energy ball milling alloying step 12 induces grain refinement and high solute concentration of the otherwise insoluble alloying element 18 in the alloy powder 20. The alloy powder 20 may present uniform dispersion of the smaller particles, also referred to as secondary phases, which may form from by-products of the raw materials 16 and 18 or impurities from milling media 26 and 28.

With reference to FIG. 1, an exemplary high-energy ball milling step 12 utilizes a high-energy ball mill 22, which may be referred to as planetary mill 22, including a rotatable base 24, which may be cylindrical, carrying one or more rotatable sample pots 26. One or more rotatable sample pots 26, which may be referred to as mill rotation pots 26, are hollow cylindrical shells and receive aluminum powder 16 and alloying element powder 18, as well as a plurality of grinding balls 28. Where high-energy ball mill 22 includes a single sample pot 26, one or more counterweights (not shown) may be utilized for balancing purposes. Where high-energy ball mill 22 includes a plurality of sample pots 26, the plurality of sample pots 26 may be utilized with each other for balancing purposes. One or more counterweights may also be used in embodiments where high-energy ball mill 22 includes a plurality of sample pots 26. The one or more counterweights may be adjustable on an inclined guide rail (not shown). In embodiments where high-energy ball mill 22 includes a plurality of sample pots 26, the sizes of the plurality of sample pots 26 may be the same or different.

Where a plurality of rotatable sample pots 26 are utilized, any suitable number may be used. In one or more embodiments, two rotatable sample pots 26 are utilized, in other embodiments, three rotatable sample pots 26 are utilized, and in other embodiments, four rotatable sample pots 26 are utilized.

One or more rotatable sample pots 26 each have an axis positioned eccentrically from the axis of rotatable base 24. In operation, one or more rotatable sample pots 26 rotate about their axis in a first direction. The axis of one or more rotatable sample pots 26 may be either horizontal or at a small angle to the horizontal. Rotatable base 24 rotates about its axis in a direction opposite the rotation of one or more rotatable sample pots 26.

Rotatable base 24 and one or more rotatable sample pots 26 rotate at different rotational speeds. Grinding balls 28 are therefore forced from one location along the circumference of sample pot 26 to a different location away from the original location. The difference in speeds between grinding balls 28 and one or more rotatable sample pots 26 produces high degree of collision energy, which is thereby transmitted to the aluminum powder 16 and alloying element powder 18. Based on the rotation, grinding balls 28 are subjected to superimposed rotational movements, generally known as Coriolis forces. The interplay between the frictional and impact forces applied on the combination of aluminum powder and alloying elements produces the high and effective degree of alloying during. The rotation speed of the rotatable base 24 may be different or identical to that of the rotatable sample pots 26. An exemplary suitable ratio to achieve desired alloying of the powder may be 1:1. In other embodiments, this ratio could be 1:2 or 1:5. In other embodiments, this ratio could be in a range of from 1:1 to 1:5, in other embodiments, from 1:2 to 1:5.

Rotatable base 24 may rotate at any suitable rotational speed. In operation, an exemplary of the rotational speed of the rotatable base 24 may be 280 RPM or approximate thereto. In other embodiments, the rotation speed of the rotatable base 24 may range from 150 RPM to 1600 RPM, in other embodiments, from 250 RPM to 400 RPM.

One or more rotatable sample pots 26 may rotate at any suitable rotational speed. In operation, an exemplary of the rotational speed of the rotatable sample pots 26 may be 280 RPM. In other embodiments, the rotation speed of the rotatable sample pots 26 may range from 150 RPM to 1600 RPM, in other embodiments, from 250 RPM to 400 RPM.

One or more rotatable sample pots 26 may be made of any suitable material, such as hardened steel, stainless steel, and tungsten carbide. In one or more embodiments, the inner surface of one or more rotatable sample pots 26 may be lined with an abrasion-resistant material, such as manganese steel or rubber.

One or more rotatable sample pots 26 may have any suitable overall volume. An exemplary of one rotatable sample pot may have a capacity of 250 mL or approximate thereto. In other embodiments, the rotatable sample pots may have a capacity that ranges from 25 mL to 5000 mL, in other embodiments, from 100 mL to 500 mL, and in other embodiments, from 200 mL to 400 mL.

One or more rotatable sample pots 26 may have any suitable fill volume, characterized as a percentage of the overall volume. This fill volume may range from 15% to 95% of the total volume. In one or more embodiments, this fill volume may be at least 25%, in other embodiments, at least 50%, and in other embodiments, at least 75% of the total volume.

Grinding balls 28 may be made of any suitable material, such as steel, stainless steel, tungsten carbide, other metals, ceramic, and rubber. Grinding balls 28 may be any suitable size, and should be substantially larger than the largest soft metal particles 16 and strength-imparting metal particles 18. Grinding balls 28 may be any suitable density, and are generally denser than the largest aluminum powder particles 16 and alloying element particles 18. Grinding balls 28 may be any suitable hardness sufficient to grind, deform, fracture, and alloy aluminum powder particles 16 and alloying element particles 18.

Grinding balls 28 may be provided at a particular weight ratio with respect to aluminum powder particles 16 and alloying element particles 18. In one or more embodiments, the weight ratio of grinding balls 28 to metal particles (i.e. both aluminum powder particles 16 and alloying element particles 18) is at least 5:1, in other embodiments, at least 16:1, and in other embodiments, at least 50:1. In these or other embodiments, the weight ratio of grinding balls 28 to metal particles is less than 60:1, in other embodiments, less than 40:1, and in other embodiments, less than 20:1. In one or more embodiments, the weight ratio of grinding balls 28 to metal particles is 5:1 or approximate thereto, in other embodiments, 16:1 or approximate thereto, and in other embodiments, 50:1 or approximate thereto.

In one or more embodiments, an additive may be utilized in the one or more rotatable sample pots 26 with aluminum powder particles 16, alloying element particles 18, and grinding balls 28. The additive may be a lubricant, which may be referred to as a process control agent (PCA). An exemplary process control agent is steric acid. The additive may utilized in amounts from 0 wt. % to 2 wt. %, in other embodiments, from 0.5 wt. % to 1.5 wt. %, in other embodiments from 0.5 wt. % to 1 wt. %, and in other embodiments, about 1.5 wt. %.

In these or other embodiments, an inert shield gas that does not react with the material being ground may be utilized as an additive. The inert shield gas may be utilized to prevent oxidation.

Alloying step 12 may be performed for any suitable length of time to achieve sufficient alloying of aluminum powder particles 16 and alloying element particles 18. An exemplary of the length of time required for alloying step 12 is 100 hours or approximate thereto. In one or more embodiments, alloying step 12 is performed for a range of time from 5 hours to 200 hours, and in other embodiments, from 20 hours to 150 hours. In one or more embodiments, alloying step 12 is performed for at least 10 hours, in other embodiments, at least 20 hours, and in other embodiments, at least 50 hours.

The length of time for alloying step 12 may also be characterized by alloying step 12 proceeding until the alloy has a particular microstructure. In one or more embodiments, alloying step 12 is performed until the alloy has a mean grain size of less than 100 nm and the solute concentration of alloying element 18 in the alloy powder 20 is larger than 50%, in other embodiments, the grain size is less than 300 nm with a supersaturation higher than 30% of alloying element 18 in the alloy powder 20.

In one or more embodiments, the above times for performing alloying step 12 may include intermittent interruption or pause times in order to allow the alloying materials to cool. In one or more embodiments, alloying step 12 includes interruptions from 15 min to 60 min every 1 hour of alloying, and in other embodiments, from 1 hour to 2 hours every 2 hours of alloying.

In these or other embodiments, alloying step utilizes a cooling medium, such as water, for preventing overheating of the alloying materials. In certain embodiments, the use of a cooling medium, including liquid nitrogen, may allow alloying step 12 to be devoid of interruption times to cool the alloying materials.

Alloying step 12 may be performed at any suitable temperature. In or more embodiments, alloying step 12 is performed at ambient temperature, which may be from 20° C. to 25° C., and in other embodiments, 23° C. or approximate thereto. In one or more embodiments, alloying step 12 occurs at the temperature of liquid nitrogen (−195.8° C.) or approximate thereto, and in other embodiments, from −150° C. to 100° C.

Alloying step 12 may be characterized by the ratio between the amount of alloying element incorporated in the alloy solid solution after alloying step 12 with the initial amount of alloying element added as raw material. In one or more embodiments, this ratio is at least 10%, in other embodiments, at least 30%, in other embodiments, at least 50%, in other embodiments, at least 70%, in other embodiments, at least 90%, and in other embodiments, at least 95% In one or more embodiments this ratio is in a range from 10% to 100%, and in other embodiments from 30% to 90%. In one or more embodiments, this ratio could reach 100% or approximate thereto.

Compacting step 14 may be any suitable step for compacting the alloy from step 20 (e.g. alloy powder) to form an alloy compact 23. Exemplary compacting steps 14 include cold compaction, equal-channel angular pressing or extrusion, and spark-plasma sintering. Compacting step 14 generally serves to apply sufficient pressure to physically bond particles from the alloy in step 20 to form alloy compact 23.

With reference to FIG. 1, an exemplary compaction step 14 utilizes a compaction assembly 30 having a die 32 and a compaction plunger 34. Alloy powder 20 is collected from alloying step 12 and provided to compacting step 14. Alloy powder 20 may be particularly provided to a receptacle 36 formed within die 32 and defined by a lower plunger 38 and an inner channel 40 within die 32. Alloy powder 20 in receptacle 36 is then pressurized by uniaxial travel of compaction plunger 34 toward lower plunger 38. During the compaction, as shown in FIG. 1, the in-progress compaction item may be referred to as a green compact 42. Upon completion of the compaction, the completed alloy compact 23 is collected. This may include lower plunger 38 moving alloy compact 23 out of inner channel 40. Though FIG. 1 shows compaction assembly 30 including only one pair of compaction plunger 34 and lower plunger 38, any suitable number of pairs may be used.

Cold compaction generally refers to a compaction step 14 where the compaction occurs without an applied heat source, and therefore may also be referred to as ambient temperature compaction. In one or more embodiments, cold compaction occurs at a temperature from 5° C. to 45° C., in other embodiments, from 20° C. to 25° C., and in other embodiments, 23° C. or approximate thereto.

The compaction pressure may be any suitable pressure. In one or more embodiments, compaction occurs at a maximum pressure of from 100 MPa to 5 GPa, in other embodiments, from 500 MPa to 4 GPa, and in other embodiments, from 1 GPa to 3 GPa. In one or more embodiments, compaction occurs at a maximum pressure of at least 1 GPa, in other embodiments, at least 2 GPa, in other embodiments, at least 3 GPa, and in other embodiments, at least 4 GPa. Uniaxial pressure during compaction may be held for a time range of from 1 minute to 1 hour, and in other embodiments, from 5 minutes to 30 minutes. Uniaxial pressure during compaction may be held for at least 5 minutes, in other embodiments, at least 10 minutes, and in other embodiment, at least 20 minutes.

The compaction may include incremental pressuring steps on the way to achieving the maximum pressure. In one or more embodiments, compaction steps occur at increments of from 10 MPa to 1 GPa, in other embodiments, from 100 MPa to 500 MPa, and in other embodiments, from 150 MPa to 200 MPa. In one or more embodiments, compaction steps occur at increments of 187 MPa or approximate thereto. In one or more embodiments, the maximum pressure may be applied directly in a single step. In one or more embodiments, the number of incremental steps may range from 1 to 16, and in other embodiments, from 1 to 200. In one or more embodiments, the number of incremental steps may be at least 10, in other embodiments, at least 15, and in other embodiments, at least 20.

The materials used to make compaction assembly 30 used for compaction step 14 may be made of any suitable materials, such as hardened steel, stainless steel, tungsten carbide, other metals, and ceramic materials.

In one or more embodiments, a method of making an alloy compact includes one or more optional secondary processing steps, such as coining or heat treatment, following the compaction step, in order to achieve further desired properties or enhanced precision. In one or more embodiments, a method of making an alloy compact may be devoid of a secondary processing step following the compaction step.

The alloy compacts (e.g. alloy compact 23) are binary alloys that contain aluminum and alloying elements (e.g. Cr, Ni, Mo, Ti, Mn, V, Nb, and Si). The alloy compacts may be characterized by the amounts of the soft metal and the strength-imparting metal within the alloy compact. In one or more embodiments, the alloy compacts include from 50 to 99 atomic percent, in other embodiments, from 75 to 95 atomic percent, and in other embodiments from 80 to 90 atomic percent of aluminum. In these or other embodiments, the alloy compacts include at least 50 atomic percent, in other embodiments, at least 75 atomic percent, in other embodiments, at least 85 atomic percent, and in other embodiments at least 95 atomic percent of aluminum. In one or more embodiments, the alloy compacts include from 1 to 50 atomic percent, in other embodiments, from 5 to 25 atomic percent, and in other embodiments from 10 to 20 atomic percent of the alloying element. In these or other embodiments, the alloy compacts include at least 1 atomic percent, in other embodiments, at least 5 atomic percent, in other embodiments, at least 10 atomic percent, and in other embodiments at least 15 atomic percent of the alloying element. It should be appreciated that the atomic, and weighted, amounts of aluminum and alloying elements utilized in the alloying step described herein may also be characterized by these atomic percentages within the alloy compacts.

The alloy compacts may be any suitable shape. An exemplary shape includes cylindrical pellets.

In one or more embodiments, alloy powder 20 may be compacted by gas-dynamic cold spray to form a thick layer or lump which can be subsequently machined into complex geometries. In other embodiments, alloy powder 20 may be compacted by additive manufacturing into any geometry according to specifications of the machine.

The alloy compacts may be characterized by size. In one or more embodiments, the alloy compacts have a diameter from 0.5 mm to 10 cm, in other embodiments, from 2 mm to 8 mm, and in other embodiments, from 3 mm to 7 mm. In one or more embodiments, the alloy compacts have a thickness of from 0.5 mm to 10 cm, in other embodiments, from 1 mm to 9 mm, and in other embodiments, from 2 mm to 5 mm.

The alloy compacts may be characterized by hardness or strength. Hardness may be determined by the Vickers hardness test. In one or more embodiments, the alloy pellets have a Vickers hardness that ranges from 100 to 1000 HV, in other embodiments, from 200 to 500 HV, and in other embodiments, from 250 to 300 HV. In one or more embodiments, the alloy pellets have a Vickers hardness of at least 100 HV, in other embodiments, at least 200 HV, and in other embodiments, at least 250 HV.

The alloy compacts may be characterized by corrosion resistance. Corrosion resistance may be characterized by pitting potential ($E_{pit}$) and transition potential ($E_{trans}$). $E_{pit}$ and $E_{trans}$ can be determined from cyclic potentiodynamic polarization (CPP). In one or more embodiments, $E_{pit}$ of the alloy compacts may be more positive than −550 mV in the scale of the Saturated Calomel Electrode (SCE), which may also be referred to with a unit of $mV_{SCE}$. In one or more embodiments, $E_{pit}$ of the alloy compacts may be more positive than −400 $mV_{SCE}$, in other embodiments, more positive than −300 $mV_{SCE}$, and in other embodiments, more positive than −200 $mV_{SCE}$. In one or more embodiments, $E_{pit}$ of the alloy compacts may be in a range of from −200 $mV_{SCE}$ to +100 $mV_{SCE}$, and in other embodiments, $E_{pit}$ may be higher than +100 $mV_{SCE}$. In one or more embodiments, $E_{trans}$ of the alloy compacts may be more positive than −600 $mV_{SCE}$, in other embodiments, more positive than −400 $mV_{SCE}$, and in other embodiments, more positive than −300 $mV_{SCE}$. In one or more embodiments, $E_{trans}$ of the alloy compacts may be in a range of from −400 $mV_{SCE}$ to −200 $mV_{SCE}$, and in other embodiments, from −350 $mV_{SCE}$ to −250 $mV_{SCE}$.

The advantageous hardness and corrosion resistance of the alloy compacts may be attributed to the concurrent influence of the grain boundary and solid solution strengthening. The alloy compacts have a uniform and refined microstructure. The alloy compacts may be characterized by grain size. The alloying step and compacting step, as well as the particular metals utilized, impact grain refinement of the alloy compacts. In one or more embodiments, alloy compacts have a grain size of less than 100 nm, in other embodiments, less than 150 nm, and in other embodiments, less than 300 nm.

Increased solid solubility of the alloying elements may be attributed the high collision energy imparted upon the alloying powder during milling. Alloy compacts may be characterized by the high content of alloying element that has been successfully incorporated in solid solution. The solute content in alloy compacts is larger than equilibrium solubility. In most cases, the alloying element has negligible equilibrium solubility in aluminum and therefore cannot be used to create alloys by conventional casting. In one or more embodiments, alloy compacts exhibit solute contents of at least 0.5 at. %, in other embodiments, at least 5 at. %, in other embodiments, at least 10 at. %, and in other embodiments at least 20 at. %. In one or more embodiments, the solute contents can range from 0.5 at. % to 20 at. %. The solute content in the alloy compacts can be measured by X-ray diffraction (XRD) analysis. XRD analysis allows for the calculation of the average lattice parameter which is directly correlated to solute content.

The alloy compacts may be characterized by porosity. In one or more embodiments, alloy compacts have a porosity of from 0 to 15%, and in other embodiments, from 5 to 10%. In one or more embodiments, alloy compacts have a porosity of at least 5%, and in other embodiments, at least 10%.

As described above, both the alloy powder and alloy compacts may be utilized in a variety of suitable applications. Where the alloy powder is utilized, the alloy powder may be consolidated to produce bulk materials for structural applications. The alloy powders may also be used for one or more of: 1) metal powder for supersonic particle deposition/cold spray for coating or repairing the engineering structures 2) metal powder for additive manufacturing 3) metal powder to produced bulk components using powder metallurgical route.

Where the alloy compacts are utilized, the alloy compacts are capable of replacing conventional alloys leading to significant improvement in the performance and life of the engineering components. The advanced properties of the alloy compacts allows for lighter engineering components and therefore the alloy compacts may achieve an increase in fuel efficiency for transportation applications, therefore reducing carbon emission.

In light of the foregoing, it should be appreciated that the present invention advances the art by providing improved alloys and corresponding methods of manufacture. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

EXAMPLES

Aluminum-5 at. % Metal alloys were synthesized via HEBM followed by cold compaction. Aluminum powder (purity 99.7%, size—50/+100 mesh) and the alloying elements powder (purity <99.S %, size—100 mesh) were loaded in hardened steel jars with hardened steel balls (10 mm diameter). Stearic acid (1.5 wt. %) was used as a process controlling agent. Steel jars were loaded and sealed in a glove box (high-purity Ar atmosphere, $O_2$<25 ppm) to maintain an inert atmosphere HEBM was performed in a planetary mill at a speed of 280 RPM for 100 h. The milling was interrupted for 30 min after every one hour of milling.

After milling completion, the HEBM powder was consolidated using an auto pellet press in a tungsten carbide die under uniaxial pressure. The load was progressively increased in 16 steps of 187 MPa for 15 sec until reaching a final pressure of 3 GPa, which was held for 5 min. The cold compacted test specimens were of 7 mm diameter and 2.5 mm thickness.

Commercial alloys (AA7075-T651, AA5083-H32, AA-6063-T6, and AA2024-T31) were used for comparing certain properties with those of the present examples.

Powder X-ray diffraction (XRD) analysis was performed in the 2-θ range of 37.5-39.5 degrees using a Cu K-alpha radiation. This region was chosen for detailed analysis of the peak corresponding to the (111) plane. The scanning speed was 0.167 deg/min with a step size of 0.0012 degrees. The grain size was calculated using Scherrer equation after subtracting the instrumental broadening. Solid solubility was also calculated. The XRD analysis was also performed in the 2-θ range of 10-80 degrees with a scanning speed of 1 degree/minute and a step size of 0.02 degrees to observe the formation of any intermetallic or unalloyed elements.

Vickers hardness was measured under the applied load of 25 g and a dwelling time of 10 sec. For each alloy, a total of 10 tests were performed and the average value was determined and reported here.

Corrosion behavior of the produced alloys and four commercial alloys (AA7075-T651, AA5083-H32, AA-6063-T6, and AA2024-T31) was studied by cyclic potentiodynamic polarization (CPP) using a VMP-300 potentiostat. All samples were polished to 1200 grit SiC sandpaper followed by rinsing with sufficient amounts of distilled water and ethanol, followed by drying. CPP tests were carried out in a conventional three-electrode electrochemical cell, using a platinum mesh as a counter electrode and a saturated calomel electrode (SCE) as a reference electrode. All tests were performed in 0.01 M NaCl. The open circuit potential (OCP) of the samples was monitored for 20 min before commencing the CPP tests. Potential scans started from −250 mV vs. OCP, and upwards with a scan rate of 1 mV/s until an anodic current of 200 $\mu A/cm^2$ was reached followed by a reverse scan to −250 mV vs. OCP. CPP tests were performed at least five times. Representative CPP curves were obtained. The pitting potential ($E_{pit}$) and transition potential ($E_{trans}$) were determined from CPP.

Figure 2:
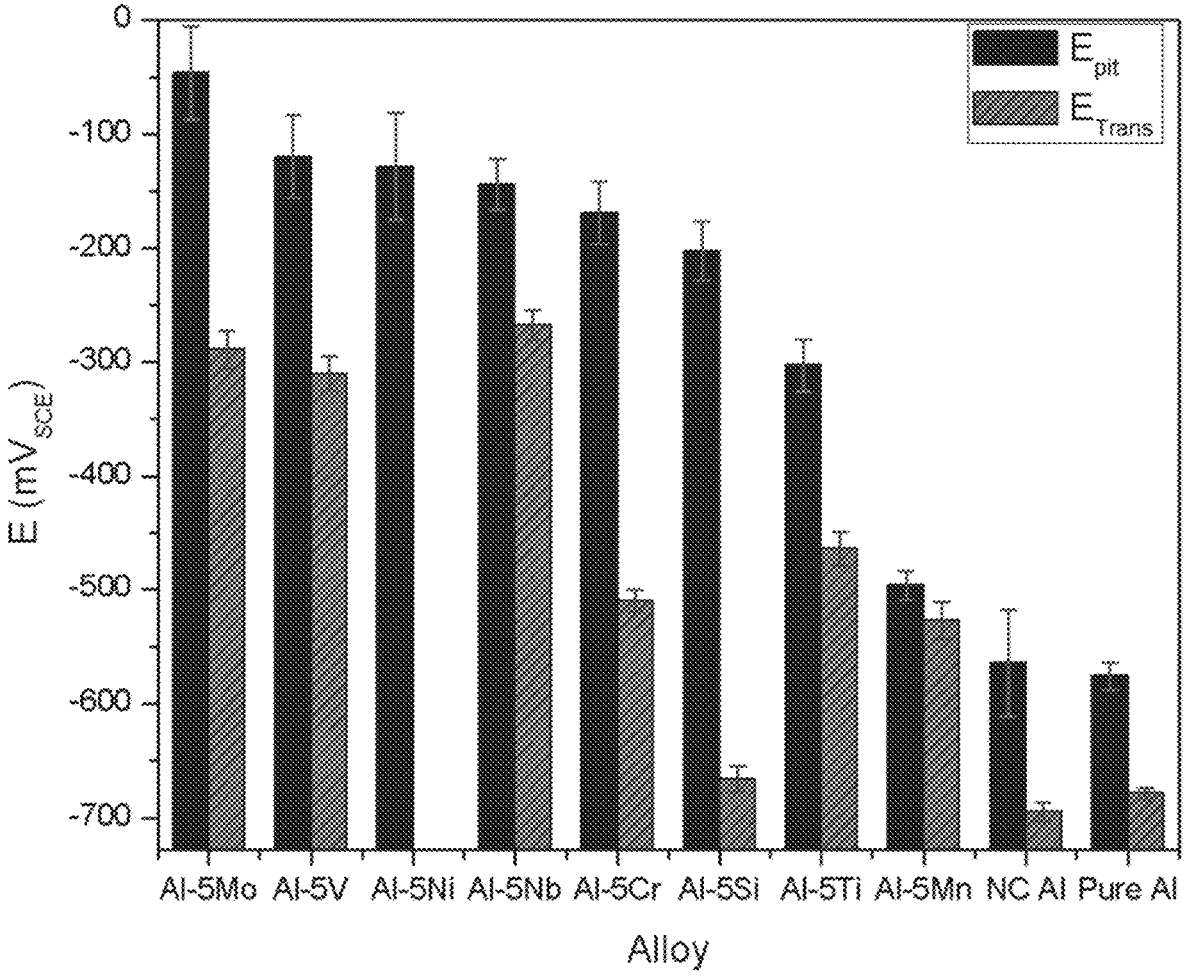
FIG. 2 is a graph showing pitting potential ($E_{pit}$) and transition potential ($E_{trans}$).

The $E_{pit}$ and $E_{trans}$ for all the produced alloys along with that of pure Al are presented in FIG. 2. Higher, that is, less negative, $E_{pit}$ indicates higher pitting corrosion resistance. $E_{trans}$ indicates repassivation capability in case of passive film breakdown. $E_{pit}$ of the HEBM alloys was significantly nobler than that of pure Al and any of the tested commercial alloys. $E_{trans}$ for all the alloys, except Al-5 at. % Si and Al-5 at. % Ni, was also significantly higher than that of pure Al.

Influence of the alloying elements in ennobling the $E_{pit}$ was in the order of Mo>V>Ni>Nb>Cr>Si>Ti>Mn, and the effectiveness of the alloying elements in ennobling $E_{trans}$ was in the order of Nb>Mo>V>Ti>Cr>Mn>Si>Ni. Considering together the ennoblement of $E_{pit}$ and $E_{trans}$, Mo, Nb, and V may be considered the most effective elements in improving the pitting corrosion resistance.

Excellent corrosion behavior of the representative alloys was further confirmed by the visual inspections and surface analysis after constant immersion tests in 0.01 M NaCl for 180 days. The average pit depth in the representative alloys was significantly lower (by at least an order of magnitude) than that for commercial alloys.

Figure 3:
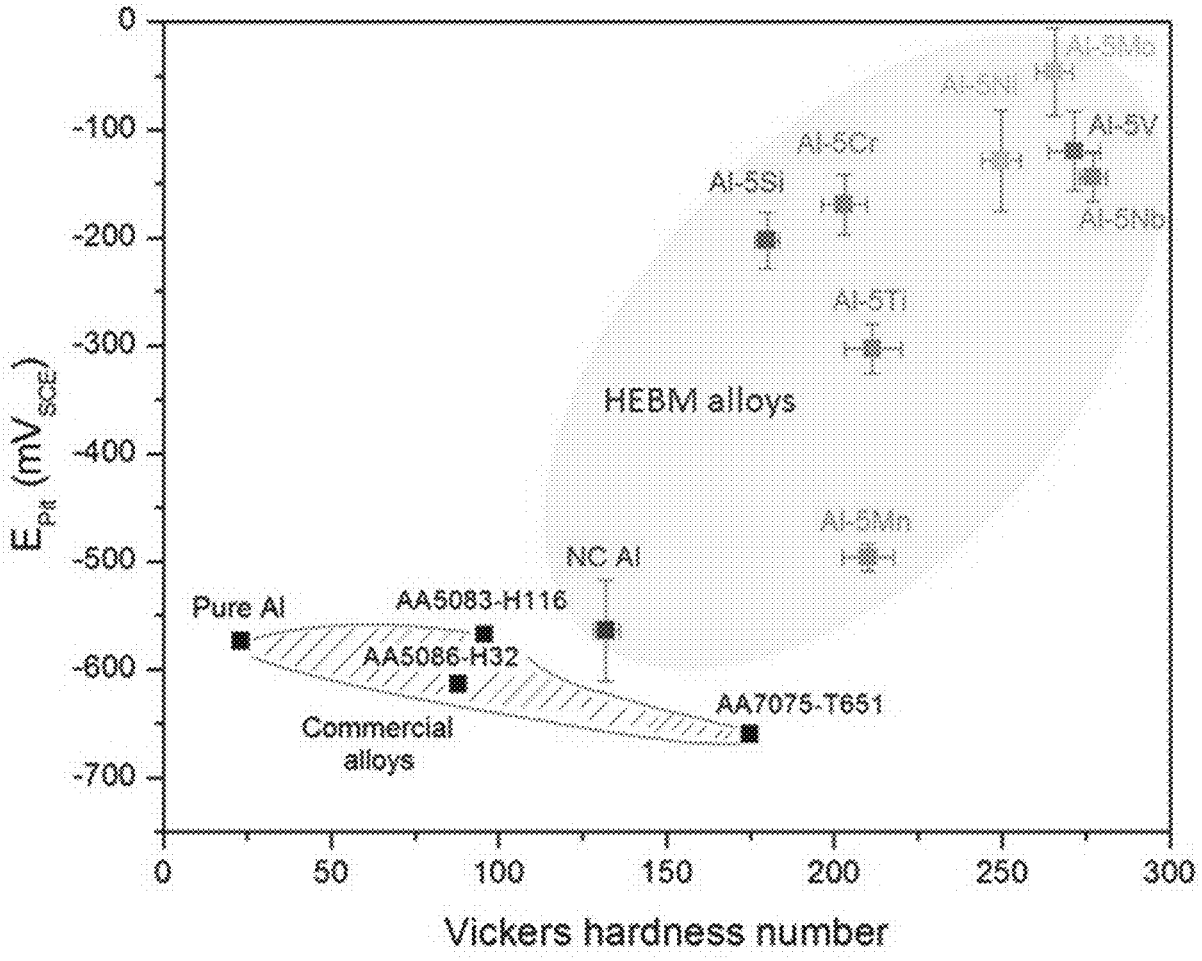
FIG. 3 is a graph showing pitting potential ($E_{pit}$) versus hardness.

The hardness of the representative alloys produced herein was also found to be significantly higher than many of the commercial Al alloys. The effectiveness of the alloying elements in increasing the hardness was Nb>V>Mo>Ni>Ti>Mn>Cr>Si. FIG. 3 shows the $E_{pit}$ (representative of corrosion resistance) vs. Vicker's hardness (representative of strength) plot for HEBM alloys. The dashed region in the plot shows a commonly noticed relationship between hardness and corrosion performance in commercial alloys, i.e. a decrease in corrosion resistance with increasing strength. Contrary to the commercial alloys, representative alloys exhibited significantly higher pitting potential and hardness. Mo, Nb, and V may be considered the most effective in improving the corrosion performance and hardness simultaneously.

Figure 4:
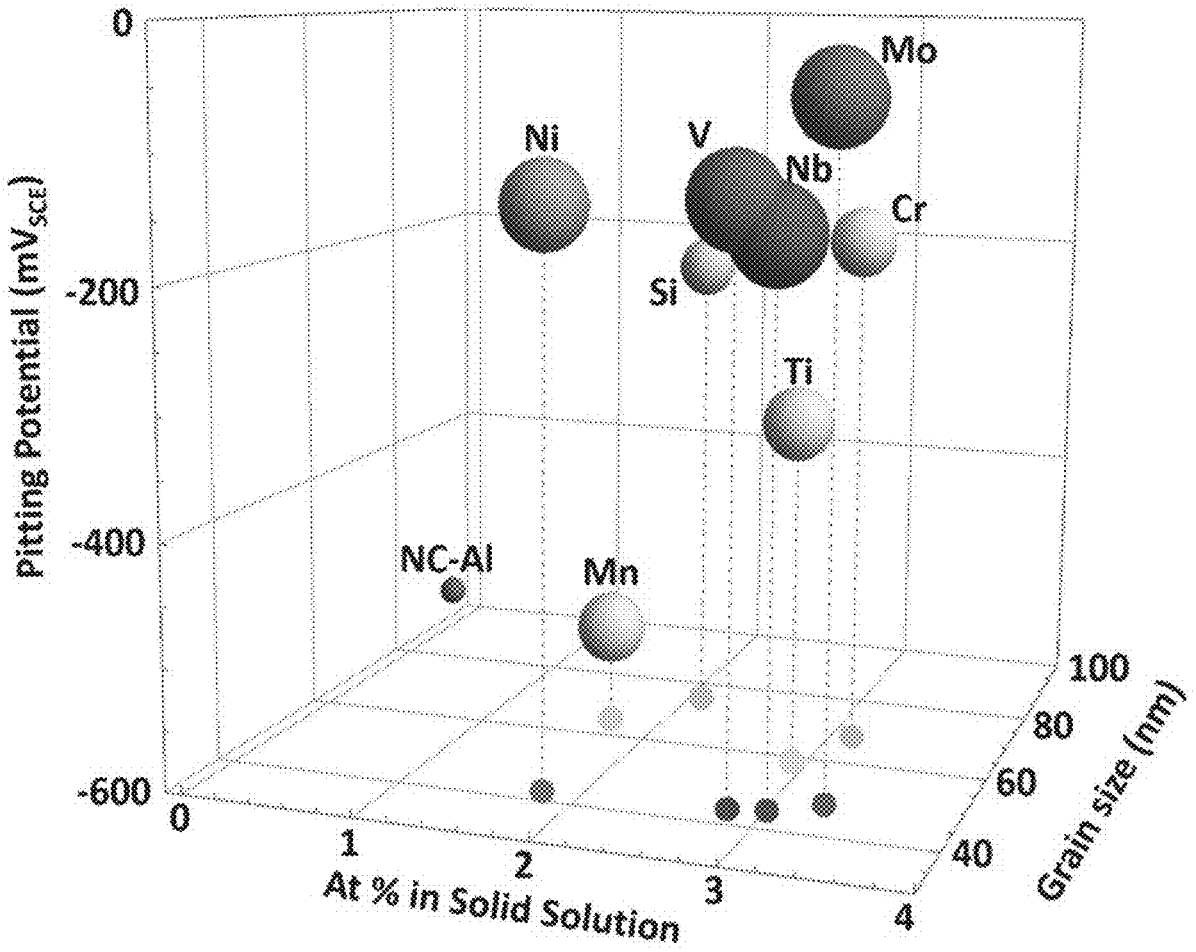
FIG. 4 is a graph showing the influence of the alloying element, grain size, and solid solubility on pitting potential.

Without being bound by theory, excellent corrosion behavior and hardness of the produced alloys was attributed to the concurrent influence of grain boundary and solid solution strengthening. The grain size and solid solubility, determined from XRD analysis, are presented on the X-Y plane in FIG. 4. The $E_{pit}$ is indicated on the Z axis and the size of the sphere indicates each alloy scales with the strength (i.e. larger radius is higher hardness). The grain size of all the alloys was <100 nm and dependent upon the alloying element. Alloying with Ni was most effective in refining the grain size (32 nm) followed by V, Nb, Mo, Ti, Mn, Cr, and Si. All of the alloying elements showed high solid solubility—significantly higher than the thermodynamically predicated values. FIG. 4 shows that Mo had the highest solid solubility in Al followed by Nb, Cr, V, Ti, Si, Ni, and Mn. However, none of the alloying elements were completely soluble at 5 at. %. XRD scans revealed peaks corresponding to the unalloyed alloying elements and intermetallics which indicated that part of the added alloying element was also present as the unalloyed element and intermetallic. XRD analysis was supported by SEM/EDXS, indicating refined secondary phases and increased solid solubility of the alloying elements HEBM caused remarkable grain refinement and solubility of the alloying elements (FIG. 4), which are deemed to be the main contributors to improved corrosion and mechanical properties. Estimates of the relative contributions of grain refinement, solid solution strengthening, and dispersion strengthening were made. The grain boundary contribution was in excess of half the measured strength in all alloys (about 57-67%) and solid solution strengthening contributed from 12% to 25%. Based on the limited information available on precipitate size and distribution available from the SEM images, the Orowan strengthening is a maximum contribution of about 2.5%.

HEBM did not cause a significant ennoblement in $E_{pit}$ and $E_{trans}$ of pure Al, which indicates the prominent role of the chemical composition and processing technology over grain refinement in improving the corrosion resistance.

Various modifications and alterations that do not depart from the scope and spirit of this invention will become apparent to those skilled in the art. This invention is not to be duly limited to the illustrative embodiments set forth herein.

What is claimed is:

1. A method of making an aluminum alloy compact, the method comprising steps of mechanically alloying aluminum powder with an alloying element metal powder to thereby form an alloy powder, wherein the mechanically alloying step is high energy ball milling, and compacting the alloy powder to thereby form an aluminum alloy compact, wherein the compacting step is a cold compacting step occurring without an applied heat source, wherein the step of compacting occurs at a pressure at least above 1 GPa, wherein the compacting step includes pelletization such that the aluminum alloy compact is an aluminum alloy pellet, wherein the aluminum alloy pellet has a pitting potential more positive than −550 $mV_{SCE}$, and wherein the aluminum alloy pellet has a hardness of at least 100 HV.

2. The method of claim 1, wherein the aluminum alloy pellet has a diameter in the range of from 0.5 mm to 10 cm.

3. The method of claim 1, wherein the aluminum alloy pellet has a corrosion resistance in the range of from −500 $mV_{SCE}$ to +100 $mV_{SCE}$.

4. The method of claim 1, wherein the aluminum alloy pellet has a hardness in the range of from 100 HV to 1000 HV.

5. The method of claim 1, wherein a plurality of the aluminum alloy pellets are formed and collected, each of the aluminum alloy pellets having a diameter or overall length of less than 10 cm.

6. The method of claim 1, wherein the alloy powder includes from 50 to 99 atomic percent of the aluminum powder and from 1 to 50 atomic percent of the alloying element metal powder, wherein the alloying element metal powder is made from a metal selected from the group consisting of chromium (Cr), nickel (Ni), molybdenum (Mo), titanium (Ti), manganese (Mn), vanadium (V), niobium (Nb), and silicon (Si).

7. The method of claim 6, wherein the alloying element metal powder is made from a metal selected from the group consisting of vanadium (V) and niobium (Nb).

8. A method of making an aluminum alloy compact, the method comprising steps of combining aluminum powder, an alloying element metal powder, and grinding balls in a ball mill rotation pot, rotating the ball mill rotation pot in a disk-planetary ball mill to thereby form an alloy powder from the aluminum powder and the alloying element metal powder, wherein the alloy powder includes from 50 to 99 atomic percent of the aluminum powder and from 1 to 50 atomic percent of the alloying element metal powder, wherein the disk-planetary ball mill is a high-energy ball mill, filling a receptacle of a die with the alloy powder, and compacting the alloy powder within the die to thereby form an aluminum alloy compact, wherein the step of compacting is a cold compacting step occurring without an applied heat source, wherein the step of compacting occurs at a pressure at least above 1 GPa, wherein the alloying element metal powder is made from a metal selected from the group consisting of vanadium (V) and niobium (Nb), wherein the aluminum alloy compact has a pitting potential more positive than −400 $mV_{SCE}$ and a hardness of at least 200 HV.

* * * * *